US011205531B2

(12) United States Patent
Kuo et al.

(10) Patent No.: US 11,205,531 B2
(45) Date of Patent: Dec. 21, 2021

(54) RESISTOR ELEMENT

(71) Applicant: VIKING TECH CORPORATION, Hukou Township, Hsinchu County (TW)

(72) Inventors: Ming-Chieh Kuo, Hukou Township, Hsinchu County (TW); Tsung-Yu Tsai, Hukou Township, Hsinchu County (TW); Chi-Yu Lu, Hukou Township, Hsinchu County (TW)

(73) Assignee: VIKING TECH CORPORATION, Hukou Township, Hsinchu County (TW)

( * ) Notice: Subject to any disclaimer, the term of this patent is extended or adjusted under 35 U.S.C. 154(b) by 0 days.

(21) Appl. No.: 16/929,952

(22) Filed: Jul. 15, 2020

(65) Prior Publication Data

US 2021/0304924 A1 Sep. 30, 2021

(30) Foreign Application Priority Data

Mar. 25, 2020 (TW) ..... 109109964

(51) Int. Cl.
*H01C 1/14* (2006.01)
*H01C 7/00* (2006.01)

(52) U.S. Cl.
CPC ..... *H01C 1/14* (2013.01); *H01C 7/00* (2013.01)

(58) Field of Classification Search
CPC ..... H01C 1/14; H01C 7/00
See application file for complete search history.

(56) References Cited

U.S. PATENT DOCUMENTS 6,636,143 B1 * 10/2003 Hashimoto ..... H01C 1/142 219/619
2008/0129443 A1 * 6/2008 Tsukada ..... H01C 17/006 338/309
2008/0211619 A1 * 9/2008 Belman ..... H01C 1/034 338/309
2008/0232075 A1 * 9/2008 Karasawa ..... H01C 7/003 361/782
2010/0134235 A1 * 6/2010 Yoshioka ..... H01C 7/12 338/21
2013/0154058 A1 * 6/2013 Boday ..... H01L 23/295 257/536
2013/0321121 A1 * 12/2013 Ohbayashi ..... H01C 7/003 338/307
2016/0247610 A1 * 8/2016 Shinoura ..... H01C 17/02
2017/0194081 A1 * 7/2017 Boday ..... H01C 17/02

* cited by examiner

*Primary Examiner* — Kyung S Lee
(74) *Attorney, Agent, or Firm* — Muncy, Geissler, Olds & Lowe, P.C.

(57) ABSTRACT

The present invention provides a structure of resistor element, which comprises a protective layer around electrodes to elongate the path of corrosion when gaseous water or sulfur leaking in. Therefore, the protective layer structure can elongate the life of the resistor element.

3 Claims, 4 Drawing Sheets

RESISTOR ELEMENT

BACKGROUND OF THE INVENTION

1. Field of the Invention

The present invention relates to a resistor element, and particularly to a resistor element provided with a protective layer around electrodes to reduce the corrosion of moisture or sulfur gas.

2. Description of the Prior Art

Generally, the resistor element comprises a conductive layer 13 covered on silver electrodes 11 to protect the silver electrodes 11. However, moisture and sulfur gas can easily invade from the gap between the conductive layer 13 and the substrate 10. As sulfur gas or moisture path 14 shown in FIG. 1, it reacts with the silver electrodes 11 to form insulated silver sulfide (Ag2S), and the resistance value may increase or fail.

SUMMARY OF THE INVENTION

In order to improve above problem, the present invention provides a resistor element, a protective layer is disposed around electrodes, and then a conductive layer is covered on the protective layer and the electrodes to elongate the invasion path of moisture or sulfur gas contacting the electrodes, which can avoid or slow down the corrosion, so that it can elongate the life of the resistor element.

Below, embodiments accompanied with the attached drawings are employed to explain the objectives, technical contents, characteristics and accomplishments of the present invention.

DESCRIPTION OF THE PREFERRED EMBODIMENTS

Figure 1:
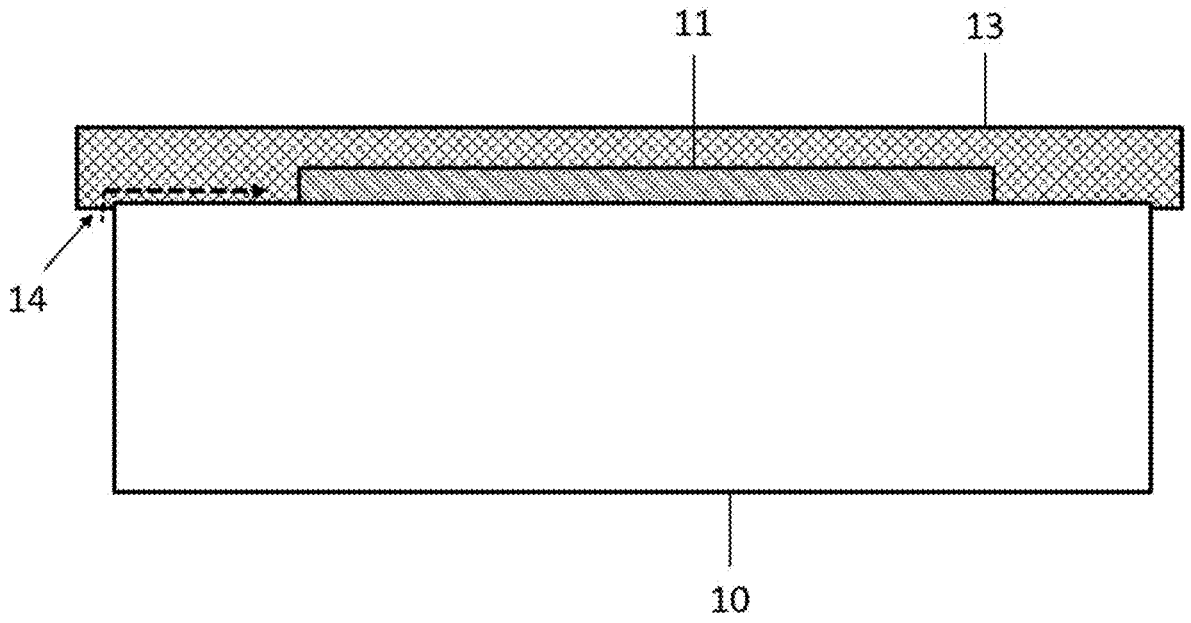
FIG. 1 is a cross-sectional view of a conventional resistor element.
Figure 2:
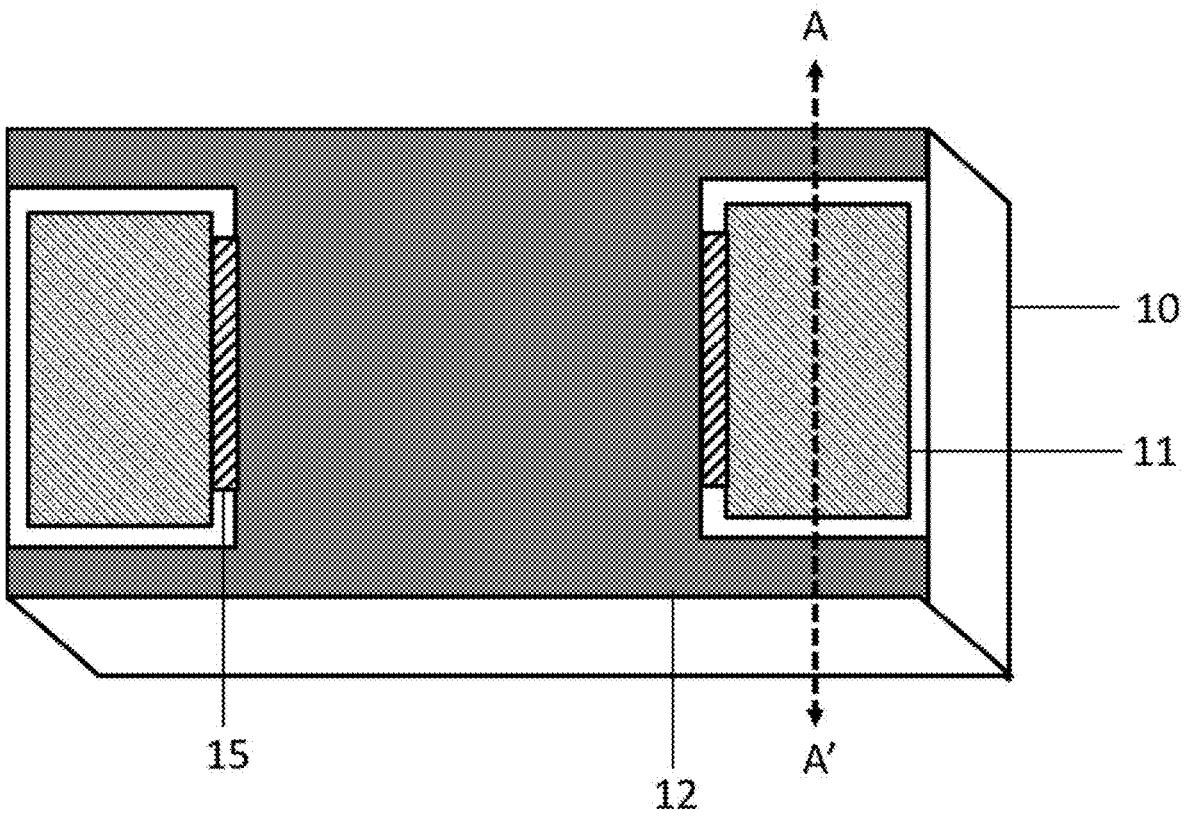
FIG. 2 is a schematic perspective view of a resistor element according to an embodiment of the present invention.
Figure 6:
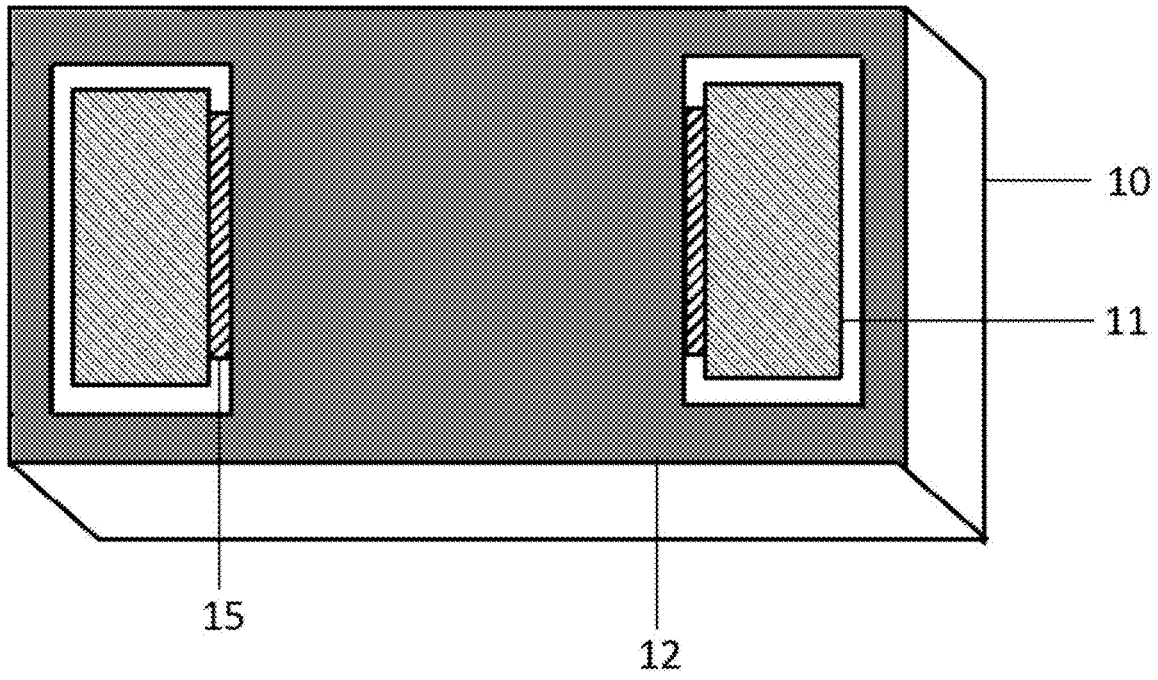
FIG. 6 is a schematic perspective view of a resistor element according to another embodiment of the present invention.

Refer to FIG. 2 and FIG. 6, which are schematic perspective views of a resistor element according to two embodiments of the present invention. In these embodiments, a protective layer 12 is disposed partially or fully around electrodes 11 of the resistor element. The resistor element of the present invention is disposed with the electrodes 11 at both ends of a substrate 10, and the protective layer 12 is disposed partially or fully around the electrodes 11 on the substrate 10.

Figure 3:
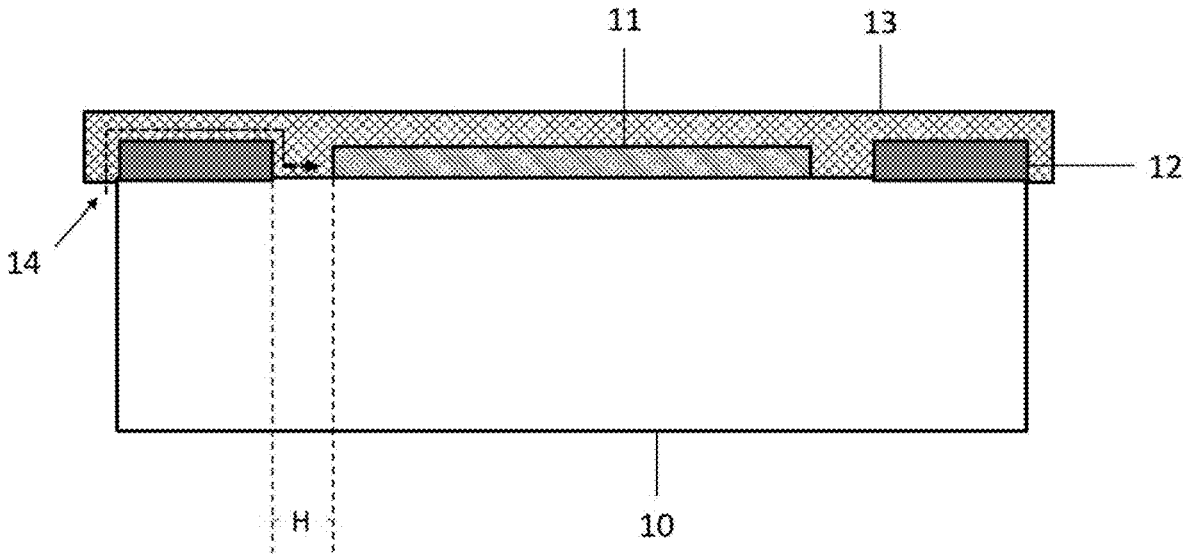
FIG. 3 is a cross-sectional view taken along line A-A' of FIG. 2.

Refer to FIG. 3, which is a cross-sectional view taken along line A-A' of FIG. 2. In this embodiment, the protective layer 12 is disposed at a certain distance H around the two electrodes 11. The protective layer 12, the two electrodes 11, and a part of the resistance layer are covered with a conductive layer 13.

Figure 4:
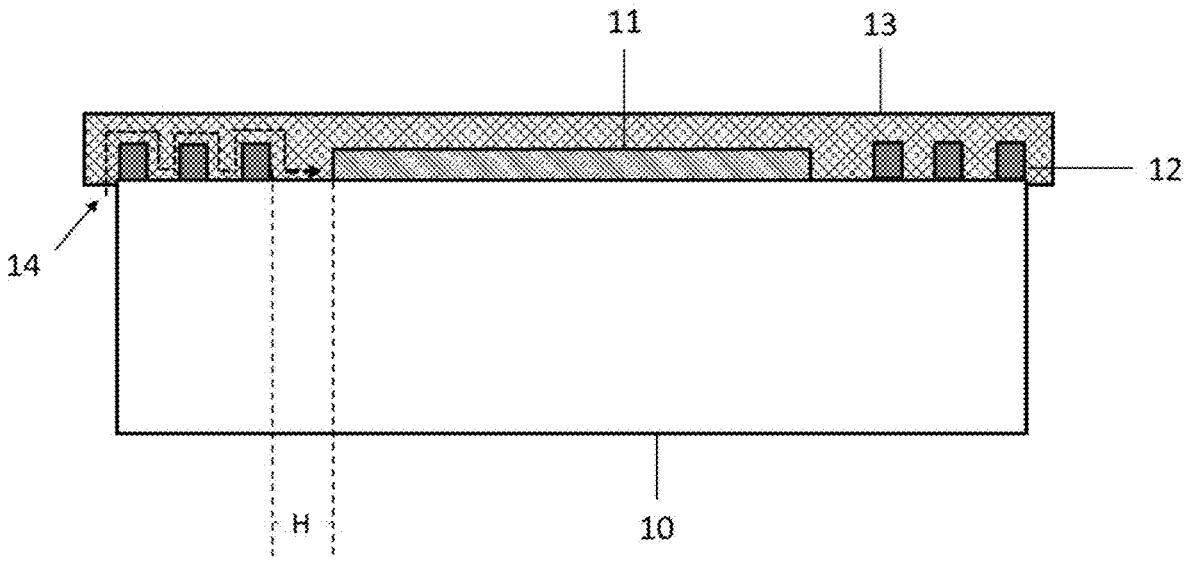
FIG. 4 is a cross-sectional view according to another embodiment of FIG. 3.
Figure 5:
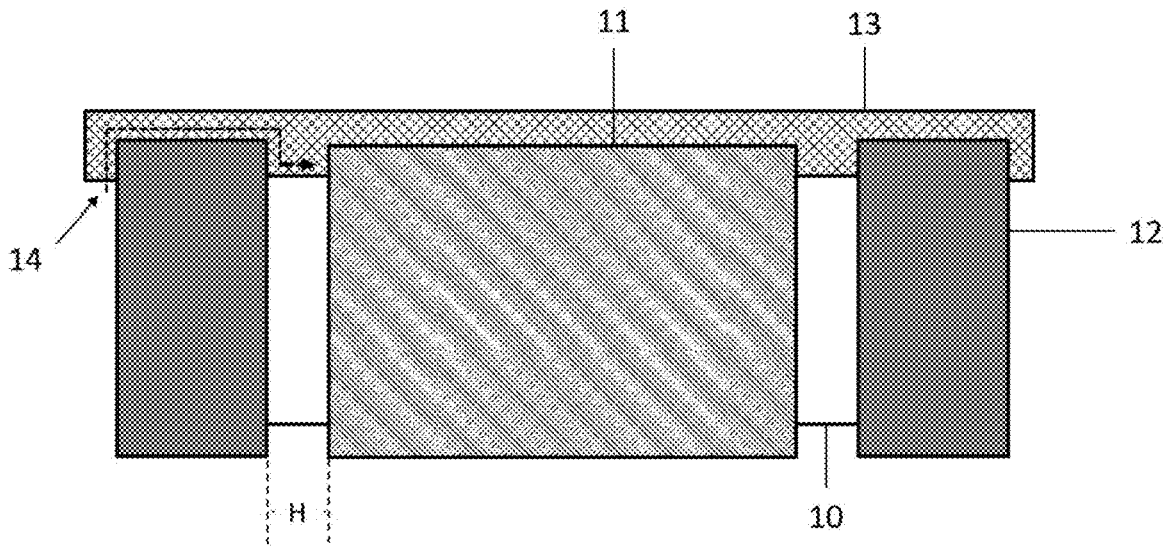
FIG. 5 is a cross-sectional view according to another embodiment of FIG. 3.

Wherein, sulfur gas or moisture path 14 depicted in FIG. 3 is longer than a conventional resistor element, so moisture or sulfur gas can be delayed contacting the electrodes 11. It is understandable that the protective layer 12 is a plurality of independent strip-shaped or zigzag-shaped structure, and arranged outward from the electrodes 11 as a center to further add a sulfur gas or moisture path 14, as shown in FIG. 4, and it can be adjusted by required request. In other embodiments, the electrodes 11 extends to a lower surface of the substrate 10, and at the same time, the protective layer 12 also extends to the lower surface of the substrate along with the electrode layer, as shown in FIG. 5.

The present invention provides a protective layer to surround the electrodes. The structure of the protective layer can block or delay the contact of sulfur gas or moisture with the electrodes from the gap between the conductive layer and the substrate, thereby elongating the life of the resistor element.

The embodiments described above are merely illustrative of the technical spirit and features of the present invention, and are intended to enable those skilled in the art to understand the present invention and practice the present invention. The scope of the patent, that is, the equivalent changes or modifications made by the spirit of the present invention, should still be included in the scope of the patent of the present invention.

What is claimed is:

1. A resistor element, comprising:

a substrate;

a resistance layer disposed on an upper surface of the substrate;

an electrode layer disposed on both ends of the substrate and connected with the resistance layer to form two electrodes;

a protective layer disposed directly on the substrate and around the electrode layer with a distance from the electrode layer, wherein the electrode layer fully exposed from the protective layer without any contact or wrap; and a conductive layer substantially covered on the protective layer and the electrode layer.

2. The resistor element according to claim 1, wherein the protective layer is a plurality of independent strip-shaped or zigzag-shaped structure.

3. The resistor element according to claim 1, wherein the electrode layer extends to a lower surface of the substrate, and the protective layer also extends to the lower surface of the substrate along with the electrode layer.

* * * * *